US007104326B2

(12) United States Patent
Grattan et al.

(10) Patent No.: US 7,104,326 B2
(45) Date of Patent: Sep. 12, 2006

(54) APPARATUS AND METHOD FOR SEVERING PIPE UTILIZING A MULTI-POINT INITIATION EXPLOSIVE DEVICE

(75) Inventors: Antony F. Grattan, Mansfield, TX (US); Michael L. Patterson, Alvarado, TX (US); James M. Barker, Mansfield, TX (US); Thomas J. Wuensche, Granbury, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 303 days.

(21) Appl. No.: 10/736,123

(22) Filed: Dec. 15, 2003

(65) Prior Publication Data

US 2005/0126783 A1 Jun. 16, 2005

(51) Int. Cl.
*E21B 29/02* (2006.01)
*E21B 43/11* (2006.01)

(52) U.S. Cl. ..... 166/297; 166/55.1; 175/4.6; 89/1.15; 102/320

(58) Field of Classification Search ..... 166/297, 166/299, 55, 55.1; 175/4.57, 4.6, 4.55, 2; 89/1.14, 1.15; 102/314–324
See application file for complete search history.

(56) References Cited

U.S. PATENT DOCUMENTS

| | | | | |
|---|---|---|---|---|
| 3,053,182 | A * | 9/1962 | Christopher | 175/4.6 |
| 4,184,430 | A * | 1/1980 | Mock | 102/307 |
| 4,290,486 | A * | 9/1981 | Regalbuto | 166/297 |
| 4,298,063 | A * | 11/1981 | Regalbuto et al. | 166/55 |
| 4,378,844 | A * | 4/1983 | Parrish et al. | 166/297 |
| 5,117,911 | A | 6/1992 | Navarette et al. | 166/299 |
| 5,467,824 | A * | 11/1995 | DeMarsh et al. | 166/297 |
| 6,053,247 | A * | 4/2000 | Wesson et al. | 166/297 |
| 6,925,937 | B1 * | 8/2005 | Robertson | 102/202 |
| 6,959,765 | B1 * | 11/2005 | Bell | 166/297 |
| 2003/0047312 | A1 | 3/2003 | Bell | 166/297 |

* cited by examiner

*Primary Examiner*—Jennifer H. Gay
(74) *Attorney, Agent, or Firm*—Al C. Metrailer

(57) ABSTRACT

A system and method for making and using a multi-point initiation explosive device that produces an enhanced pressure wave for severing tubing, pipe or casing in an oil or gas well. At least two opposed initiators initiate a column of explosive material from opposite ends, thereby generating opposing pressure waves propagating toward a midpoint between the initial initiators. A shaped-charge assembly with a liner located at the midpoint initiates immediately prior to the arrival of the opposing pressure waves and forms a fast moving jet to pre-score the target pipe prior to the arrival of the pressure pulse propagating from the initial detonations.

39 Claims, 3 Drawing Sheets

APPARATUS AND METHOD FOR SEVERING PIPE UTILIZING A MULTI-POINT INITIATION EXPLOSIVE DEVICE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention is concerned with method for making and using a multi-point initiation explosive device that produces an enhanced pressure wave and more particularly to a system and for severing tubing, pipe or casing or otherwise impacting downhole structures in an oil or gas well using a multi-point initiation explosive device.

BACKGROUND OF THE INVENTION

The use of explosive devices for severing tubing, pipes, or casings used to line wells such as oil and natural gas wells and the like, is well-known in the art. For example, U.S. Pat. Application Publication No. U.S. 2003/0047312, published Mar. 13, 2003, by William T. Bell, discloses a method and device for severing drill-pipe, casing and other massive tubular structures by the remote detonation of an explosive cutting charge.

Commercial activities related to the exploration for gas, crude petroleum, minerals and even water or steam require the use of tubing material of large diameter and wall thickness suspended in a borehole that may penetrate the Earth's crust as much as several miles. The borehole may be deviated in any number of degrees, thus creating turns and angles within the borehole. Extreme hydrostatic pressures are experienced at such depths and in such environments.

During commercial operations of wells, events may occur that require the tubing string to be severed at a point below the surface. For example, the wellbore sidewall may collapse against the drill string preventing it from being moved within or removed from the well bore. Typically, it is desirable to remove as much of the pipe as possible by severing the pipe at a point immediately above the point where the pipe is trapped and withdrawing the free portion.

In such an event, a wireline tool may be suspended within the central, drill-pipe flow bore to locate and measure the depth position of the obstructive point. This information may be used to position an explosive severing tool within the drill-pipe flow bore to sever the drill string above the obstructive point, and thereafter withdraw the free drill string above the obstructive point and thereby salvage as much of the wellbore investment as possible.

Typically, an explosive drill-pipe severing tool comprises a significant quantity of high order explosive such as RDX, HMX or HNS compacted into high density "pellets." The pellet density is typically compacted to achieve upon detonation a pressure wave velocity that provides a pulse of pressure that severs the pipe.

Typically, the pipe severing tool comprises an outer housing that is a thin-wall metallic tube of such outside diameter that is compatible with the drill-pipe flow bore diameter intended for severance. The upper end of the outer housing tube is sealed with a threaded plug having insulated electrical connectors along an axial aperture. The outer housing upper end plug is externally prepared to receive a suspension string such as an electrically conductive wireline bail or a continuous tubing connecting sub.

Typically, the lower end of the outer housing tube is closed with a tubular assembly that includes a stab fit nose plug. The nose plug assembly includes a relatively short length of heavy wall tube extending axially out from an internal bore plug. The bore plug penetrates the barrel of the outer housing tube end whereas the tubular portion of the nose plug extends from the lower end of the outer housing tube. The bore plug is sealed about its perimeter by high pressure O-Rings and secured around the outside diameter of the outer housing tube.

The tubular portion of the nose plug typically provides a closed chamber space for enclosing electrical conductors and a lower detonator housing for enclosing an initiator such as an exploding bridge wire (EBW) initiator or an exploding foil initiator (EFI).

Within a typical pipe-severing tool, the upper end of the outer housing tube is an inner tubular housing for enclosing an electronic detonation cartridge. Below the inner tubular housing is a cylindrical, upper detonator housing. Below the upper detonator housing is a quantity of explosive material. The lower detonator housing is resiliently separated from the bore plug of the stab fit nose plug by a suitable spring. The upper detonator housing includes a closed chamber space for enclosing electrical conductors, commonly an exploding bridge wire (EBW) initiator or an exploding foil initiator (EFI).

Typically, the explosive material consists of explosive pellets formed as solid cylinder sections having an axial aperture that are located within the outer housing barrel such that the uppermost pellet face contiguously engages the upper detonator housing and the lower detonator is in contiguous engagement with the lowermost pellet face. The assembly is then compressed by the loading spring between the nose plug shoulder and the lower detonator housing until abutment between the nose plug shoulder and the lower distal end of the outer housing tube.

The use of explosive charges to penetrate pipe and tubing in an oil well is well known in the art. The Bell patent discloses an apparatus and method for severing drill-pipe by simultaneous detonation of opposing ends of a column of explosive pellets by electrically initiated exploding wire initiators (EBW). Additionally, the use of shaped-charges to perforate pipe or tubing in a wellbore is well known. A shaped-charge is a generally cylindrical or cup-shaped housing having an open end and within which is mounted a shaped explosive which is configured generally as a hollow cone having its concave side facing the open end of the housing. The concave surface of the explosive is lined with a thin metal liner that, as is well known in the art, is explosively driven to hydrodynamically form a jet of material with fluid-like properties upon detonation of the explosive. This jet of viscous material exhibits penetrating power to pierce the well pipe, its concrete liner and the surrounding earth formation. Typically, the shaped-charge is configured so that the liner along the concave surface thereof defines a simple conical liner with a small radial apex at a radial angle located toward the axis of the down-hole tool used to position the shaped charge in the borehole. Shaped charges of the type typically used to penetrate pipe, tubing or casing in a well bore may be conical shaped charges, linear shaped charges or curvilinear shaped charges. Shaped charges may be of the lined or unlined type.

Generally, the resulting shaped-charge is initiated by means of a detonator that triggers a timed sequence of initiation of a fuse assembly. The fuse assembly conducts a signal such as the continuous ignition of a detonator cord or a charge of electricity to an initiator located at the initiation site proximally located on the explosive material. The initiator may be a booster or priming charge positioned at or near the apex of the shaped-charge and located so that the detonating fuse, detonating cord or electrical initiator may be positioned in close proximity to the priming charge for initiation of the shaped-charge.

The depth at which such operations may occur may result in large hydrostatic pressure that tends to attenuate and suppress the pressure of the explosive pulse and prevent severance of the tubing.

In order to overcome the effect of such hydrostatic pressure suppression and to enhance the pipe severing pressure pulse, effort has been made in previous tools to simultaneously detonate the explosive from opposite ends of the explosive column. Simultaneous detonations at opposite ends of the explosive provide a pressure wave front from one end colliding with a pressure wave front from the opposite end of the explosive at the midpoint of the explosive. The collision of the pressure wave fronts may multiply the effect of the explosion, at the point of collision, by about 4 to 5 times the normal pressure.

Notwithstanding the increase of the intended pipe severing pressure pulse generated by the colliding wave fronts, the increase of pressure may be insufficient to effect the desired severance of tubing at certain depths and for certain thicknesses of pipe, tubing or casing.

SUMMARY OF THE INVENTION

Some embodiments of the present disclosure address a multi-point initiation explosive severing device comprising an exterior housing having an interior extending between opposite distal ends of the housing. An explosively coupled collection of explosive material is located within the interior housing. First, second, and third initiators are coupled to the collection of explosive material at first, second, and third locations respectively, with the third location between the first and second location. In one embodiment at least one detonator is used to initiate a timed sequence of initiation of the initiators coupled to the explosive materials.

In one embodiment of the disclosure, the multi-point initiation explosive device includes a shaped charge and liner that causes pre-scoring of the pipe or tubing at the point of intended separation, enhancing the separation effect of the multiple pressure waves and the subsequent wave collisions.

In another embodiment, the disclosure addresses a method for severing a tubular structure which includes locating within the tubular structure an explosively coupled collection of explosive material having a first region, a second region, and a third region at least partially in between the first and second regions. At least two pressure waves traveling through the explosive material are created by using at least one initiator coupled to the first region of explosive material to initiate a first pressure wave in the first region of explosive material and by using at least one initiator coupled to the second region of explosive material to initiate a second pressure wave in the second region of explosive material. At least one additional pressure wave is created in between the first and second pressure waves by using at least one initiator coupled to the third region of explosive material to initiate a third pressure wave in the third region of explosive material.

In another embodiment, the disclosure addresses a method for impacting a structure, wherein the method includes locating proximate to the structure an explosively coupled collection of explosive material having a first region and a second region. At least two pressure waves are created traveling through the explosive material with at least one wave originating in the first region of explosive material and at least one wave originating in the second region of explosive material. At least one additional pressure wave is created in between the first and second pressure waves.

BRIEF DESCRIPTION OF THE DRAWINGS

The invention, together with further advantages thereof, may best be understood by reference to the following description taken in conjunction with the accompanying drawings in which.

DETAILED DESCRIPTION

Figure 1:
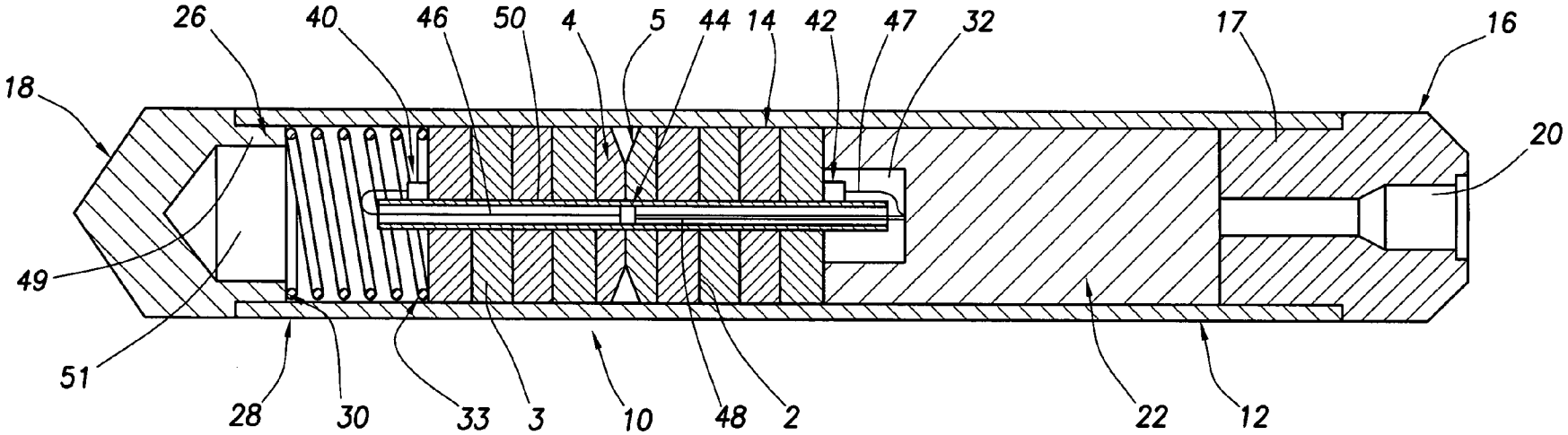
FIG. 1 is a cross-sectional diagram illustrating an assembled explosive cartridge assembly with a conical liner having a hemispherical apex.

The present disclosure relates to an explosive severing device and a method for producing an enhanced pressure wave phenomenon. The device is used typically for severing thick wall tubular targets by detonating an explosive charge within the annulus of a target pipe where conventional cutting devices are limited in effect or ineffective due to extreme thickness of the target pipe or due to extreme hydrostatic pressures attenuating the effect of the explosion, such as in a deep oil or gas well. The device and method are not limited to these types of targets and may also be used for thin wall targets and less extreme hydrostatic pressures.

The device and method of the present disclosure typically use an explosive material or collection of explosive materials to create multiple pressure waves. An explosive material is a material that, under defined conditions, will explode creating a pressure wave. An explosive material maybe made up of multiple components, which include multiple explosive materials and may include non-explosive materials, so long as the total collection is explosive. There may also be neighboring groups with differing combinations or mixtures of explosive materials. Where such groups are explosively coupled, they may still be referred to collectively as "explosive material" even though there may be multiple materials present and there may even be multiple distinct neighboring groups each consisting of multiple materials.

For the present disclosure, exploding will be defined as undergoing a rapid chemical reaction with the production of noise, heat, and violent expansion of gases and will not include nuclear reactions. The explosion travels through the material and is fueled by the explosive material. If the pressure wave created by and driven by the explosion travels faster than the speed of sound, then the pressure wave may be referred to specifically as a shock wave and the explosion may be referred to as a detonation. If the pressure wave created by and driven by the explosion travels slower than the speed of sound, then the pressure wave may be referred to more generally as a pressure wave and the explosion may be referred to as a deflagration. While in many examples the explosive material will explode by detonation and create shock waves, alternate examples providing many of the advantages of the present invention may use pressure waves created through a deflagration of explosive material. For the purposes of the present disclosure shock waves and pressure waves will be collectively referred to as pressure waves.

Additionally, where neighboring groups or sections of explosive material are placed contiguous or in close enough proximity that explosion of one group or section of explosive material results in explosion of a neighboring group or section of material (by detonation or by deflagration) then the two neighboring groups or sections are defined as explosively coupled. There may be barriers or intermediate materials between the explosively coupled materials, so long as explosion of at least one results in explosion of the coupled group.

The multiple embodiments of the invention consist of two general, geometric arrangements. In one embodiment, a column of explosive material and multiple initiators are geometrically apportioned along a common axis according to explosive timing and cutting requirements. The column may be one contiguous collection of explosive material, a collection of sections of different combinations of explosive materials that are contiguous, or a column of sections of explosive material(s), which may be separated by walls or other materials but are still explosively coupled. In any of the above cases, the explosive material(s) would be explosively coupled. In another embodiment, a shaped charge cartridge assembly or other wave shaping or metal jet projectile forming assembly is positioned between two columns of explosive material arranged along a common axis. The explosive columns may or may not be of equal length with respect to the common axis and the explosive types may or may not be of the same types, based on velocity of explosion requirements. In another embodiment, the explosive material or sections of explosive material may be explosively coupled and arranged in a non-columnar shape such as a spherical mass or other shape which may be more useful for certain desired wave interactions or delivery circumstances.

The present disclosure describes multiple geometric and timing arrangements for the initiation of the explosion in the explosive material. Generally, the geometric location and the timing of the initial initiation of the explosion in the explosive materials is designed to cause multiple pressure waves to originate at opposing ends of the explosive material and to cause the pressure waves to collide at or near a midpoint. An additional initiation of an explosion in the explosive material is designed to occur at or near the point of collision of the initial pressure waves, either before, after or simultaneously with the initial initiations. The process is commonly triggered by a primary detonator that is coupled to the respective initiators with the timing controlled between the initial triggering of the detonator to the actual initiation at the multiple initiation points by the respective initiators. For the purposes of this disclosure, the term coupled would include direct connection or contacting as well as indirect coupling where, for example, actions on or by one element of a coupled pair operatively affect the other element of the coupled pair even in the absence of direct connection. The combined effect of the multiple pressure waves creates an enhanced pulse or pulses of pressure that causes severance of the target pipe. While the initial triggering device is referred to as a primary detonator, the term is intended to denote any device, switch, machine or other instrument which is used to begin the sequence leading to the initiation of explosions (detonations or deflagrations) in the explosive material. Further, while in many instances there will be a single detonator to most accurately control the timing of the multiple initiations, in alternate embodiments, there may be multiple detonators separately and independently triggering different aspects of the initiation sequence.

In an additional embodiment, the initiation point located at or near the collision point of the initial pressure waves is a shaped-charge device with a liner that results in a jetting action of the liner material against the target pipe immediately prior to the arrival of the pressure waves resulting in a pre-scoring of the target pipe that weakens and enhances the severance of the target pipe. In another embodiment, the shaped charge may be unlined.

A number of potential approaches may be used to control the timing of the initiation of the explosive material and the point of enhancement of the resulting pressure waves and pressure pulse. The initiation technique requires that at least two precisely timed initiation events are created with the purpose of interacting with a third or subsequent initiation events occurring at a location between the initial pressure fronts or interacting with the multiple pressure fronts generated. The first two pressure fronts serve to enhance a third, prior pressure front or to confine a third, subsequent pressure event. The enhanced pressure interaction generates more effective cutting of the target pipe due to the pressure wave interaction and destructive effect on the target pipe.

One approach is to have simultaneous initiations occur at opposing ends of a column of explosive material, generating multiple wave fronts traveling toward a point between the column of explosive material and a third initiation event of a shaped charge or other wave shaping assembly with a liner that jets radially from the third explosion site against the inner wall of the target pipe resulting in a weakening and pre-scoring of the target pipe immediately prior in time to the arrival of the pressure pulse generated by the opposing, initial initiations of explosive material. The third initiation event may be timed to occur immediately prior to the time of arrival of the of the pressure pulse generated by the opposing, initial initiations of explosive material.

In an alternate embodiment, the initiation of the third explosive event may be simultaneous with or subsequent to the time of arrival of the of the pressure pulse generated by the opposing, initial initiations of explosive material.

The initiation of the explosives maybe accomplished by any number of different initiators including optical initiators, electrical initiators, or electrical detonators (collectively referred to herein as electrical initiators), mild detonating fuses or a timed explosive train (collectively referred to herein as explosive initiators). Electrical initiation may be accomplished by using a high voltage discharge system and EBW or EFI type initiators where the high voltage discharge system may have additional timing circuitry to produce the required delays between initiation events. Explosive initiation may also be achieved by using Mild Detonation Fuze (MDF) to establish a non-disruptive initiating explosive train through the explosive column (without pre-detonation of the column) with timing achieved using pre-measured lengths of MDF. Another method to achieve timing through an explosive train is to use different types of explosive selected according to the variations of the time taken for different portions of the explosive column to be consumed. Pressure wave shape could also be manipulated in this manner, with for example a core made up of a faster burning explosive and a surrounding cylinder of slower burning explosive, both of which could be part of the same explosive region or grouping. Regardless of the method of timing, multiple initiation points are generated to produce interacting pressure fronts. Similarly, regardless of the method of use, the initiators are coupled to the explosive material, either by being in contact with the explosive material or in proximity and with access sufficient that the initiator can initiate an explosion in the explosive material. Multiple pressure wave interactions may be achieved by introducing subsequent initiation points and generating additional pressure wave collision points and pressure wave interactions.

Regardless of the final design, the enhanced device consists of multiple initiation points (at least 3 initiation points are used) to produce confining or interacting pressure wave fronts that enhance the pressure and effect of the multiple initiation events to produce a severing effect of the target pipe through pre-scoring or pressure wave interaction techniques.

Explosive Assembly

The explosive assembly generally includes a column of explosive material with initiators located at multiple, opposing or geometrically dispersed locations on or within the explosive material. FIG. 1 illustrates the dual-ended, simultaneous initiation with a shaped-charge and liner located at a point between the multiple initiators. An explosive assembly can be manufactured using a number of initiating devices such as mild detonating fuse and booster assemblies or exploding bridge wire (EBW) initiators or an exploding foil initiator (EFI) or other initiators to initiate an explosion of the explosive material.

FIG. 1 is a cross-sectional view of the explosive assembly 10 having a tubular outer cartridge housing 12 and an internal bore 14 and containing an upper column of explosive material 2 sealed at an upper end by a connection plug 16 and at the opposite, lower end, a lower column of explosive material 3 sealed by a bullnose plug 18. The connection plug 16 includes an axial bore 20 for routing detonation signal leads to a fuse housing 22, referred to more generally as part of the initiation assembly or assemblies. A boss 17, projecting from the lower end base of the connection plug 16, is externally threaded for the attachment of the desired suspension string such as an electrical wireline or service tubing to the outer cartridge housing 12. The fuse housing 22 is proximally located to an upper explosive material 2.

The lower end of the outer cartridge housing tube 12 is operatively opened and closed by a bullnose plug 18. The bullnose plug 18 comprises a plug base 26 having an O-Ring fitting within the lower end of the outer cartridge housing bore 28. Projecting from the interior end of the plug base 26 is a guide tube boss 30 having an axial throughbore 49 and a receptacle socket 51 for a lower initiator assembly. The plug base 26 is secured to the outer cartridge housing tube 12 by fasteners such as shear pins or screws or externally threaded to accommodate the internal bore of the lower end of the outer cartridge housing. Projecting from the upper interior end of the base plug 26 is a guide tube boss 30 for contacting a lower end of a compression spring 33. The upper end of the compression spring 33 is in proximal contact with the lower end of a lower mass of explosive material 3.

In one embodiment, a third explosive material 4 is proximally located between a lower face of the upper explosive material 2 and an upper face of the lower explosive material 3. In another embodiment, the third explosive material comprises a shaped-charge device with a conical profile liner 5. In the described embodiments, the explosive material 2, 3 and 4 maybe the same type of material or different materials or different combinations of materials. Additionally, each explosive material may be a uniform material or a composite or mixture of different materials. Such different materials could be uniformly mixed, placed generally in radial or axial regions, such as a core and a surrounding cylinder or as a series of disks, or otherwise combined in a contiguous manner or more generally in an explosively coupled manner.

Electrical Assembly

The upper end of the fuse housing 22 is proximally contacted by the lower end of the connection plug 16. The fuse housing 22, or more generally the initiation assembly, encloses a primary detonator such as a capacitive firing cartridge for triggering the sequential, timed initiation of an upper initiator 42 and a lower initiator 40 and middle initiator 44 located a point between the first and second initiators.

In one embodiment, a first mild detonating fuse 46 runs down the inside of a tube 50 that extends axially through the column of explosive pellets and a second mild detonating fuse 47 of equal length is spiraled above the column of explosive pellets. Because of their equal lengths, they produce simultaneous initiation of the top and bottom of the column. In this embodiment, a third mild detonating fuse runs 48 through the tube 50 to an initiator 44 at a point between the first and second initiation points. For the purposes of this disclosure each of these fuses may be referred to as an initiation assembly creating a path between the primary detonator and one of the initiation sites. As each initiation assembly is coupled to the detonator, one of skill in the art will recognize that the set of initiation assemblies could also be referred to as a single initiation assembly combining the separate paths. In this disclosure, language referring to separate assemblies for each path is intended to equally address both points of view.

In other embodiments, the explosive assembly may be manufactured with exploding bridge wire (EBW) initiators or an exploding foil initiator (EFI) or other initiators to initiate explosion of the explosive material.

In other embodiments, there may be multiple first, second and third initiations. In all embodiments, there will be at least three initiations timed to produce a first pressure wave (or set of pressure waves) beginning at a first location of an explosive mass and a second pressure wave (or set of pressure waves) beginning at a second location of an explosive mass and a third or subsequent initiation at a point between the first location and the second location preferably a point positioned such that the pressure waves from the first and second initiations intersect at or near the third or subsequent initiation point between the first and second initiation points.

A fuse housing 22 is secured to and extends from the lower end of the connection plug 16 into the internal bore 14 of the outer cartridge housing 12. Below the fuse housing 22 is an upper initiator housing 32. An upper initiator such as an exploding bridge wire (EBW) initiators or exploding foil initiator (EFI) is seated within a receptacle socket formed in the upper initiator housing laterally of the housing axis. A conduit 50 connects the capacitive firing cartridge within the fuse housing to the upper initiator. The conduit 50 also connects the capacitive firing cartridge to a lower initiator. The same conduit 50, or in some embodiments different conduits, connects the capacitive firing cartridge to an initiator located at a point between the upper and lower initiators. Detonation signal conductor leads 46 and 48 are routed from the firing cartridge through the upper initiator housing and along the wall of housing bore 14. A conductor channel routes the leads 46 through the nose plug base 26 into the nose tube interior 51.

Another method used to generate timed sequential detonations of the explosive column is to utilize electric initiators such as Exploding Bridge Wire (EBW) initiators and Exploding Foil Initiators (EFI's). An exploding bridge wire (EBW) initiator comprises a small quantity of moderate to high order explosive that is detonated by the explosive vaporization of a metal filament or foil (EFI) due to a high voltage surge imposed upon the filament. A capacitive firing cartridge is basically an electrical capacitor discharge circuit that functions to abruptly discharge with a high threshold voltage. Significantly, the EBW initiator or EFI is relatively insensitive to static or RF frequency voltages. Consequently, the capacitive firing circuit and EBW or EFI function cooperatively to provide a substantial safety advantage. An unusually high voltage surge is required to detonate the EBW initiator (or EFI) and the capacitive firing cartridge delivers the high voltage surge in a precisely controlled manner. The system is relatively impervious to static discharges, stray electrical fields and radio frequency emissions. Since the EBW and EFI initiation systems are functionally the same, hereafter and in the attached invention claims, reference to an EBW initiator is intended to include and encompass an EFI.

Figure 2:
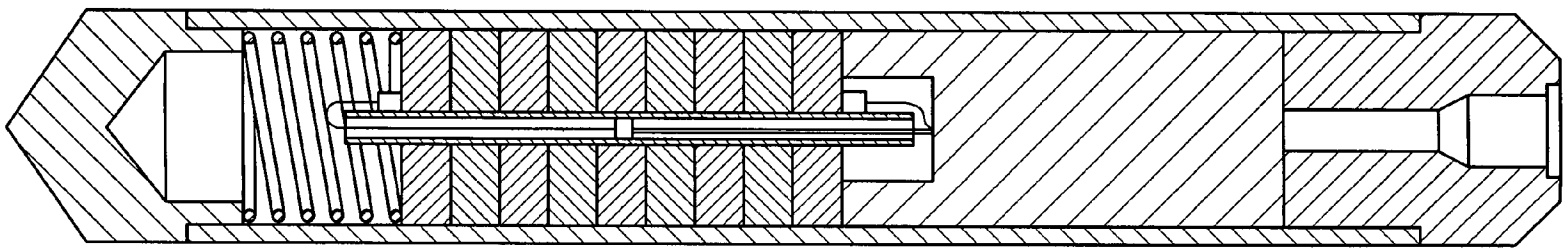
FIG. 2 is a cross-sectional diagram illustrating an assembled explosive cartridge assembly including a single initiator located at a point between multiple initiators.

FIG. 2 illustrates a separate embodiment of an explosive assembly that generally includes a column of explosive material with initiators located at multiple, opposing or geometrically dispersed locations on or within the explosive material. FIG. 1 illustrates the dual-ended, simultaneous initiation with third initiator located at a point between the multiple initiators. Other electric and non-electric techniques known to those of skill in the art may also be used to effectively transmit the detonation signal or activity from the primary detonator to the multiple initiation points in, on, or coupled to the explosively coupled collection of explosive material.

Method of Operation

Figure 3:
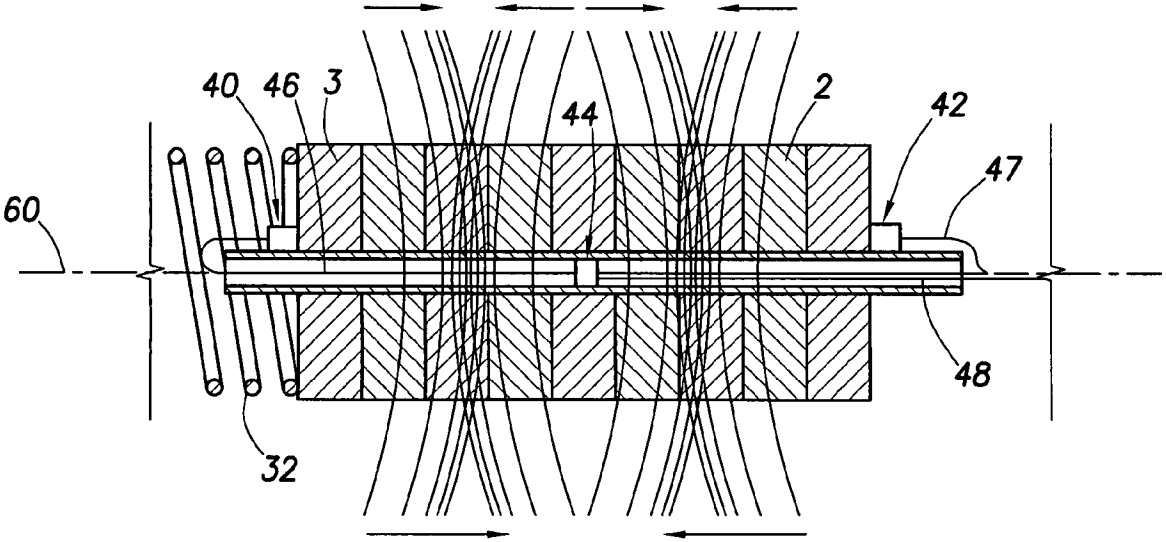
FIG. 3 is a cross-sectional diagram illustrating an explosive cartridge assembly and including opposed wave fronts and a shaped-charge.

FIG. 3 illustrates an embodiment of a multi-point initiation system where accurately timed initiation points produce multiple pressure wave fronts and multi-pressure wave interactions. A first initiator 40 and a second initiator 42 are designed to be initiated simultaneously and preferably before a third initiator 44. At a predetermined time, the pressure wave fronts created by the first and second initiators have propagated in equal but opposing directions along the common axis 60. At a predetermined time, a third initiator 44 starts at a third initiation point between the first and second initiators. The third pressure wave propagates in equal and opposing directions axially through the column of explosive material and radially through the column of explosive material. The pressure wave fronts created by the first and second initiators are confining in nature and each create a relatively incompressible wave front propagating axially toward a point between the first and second initiators. The pressure waves created by the third initiator 44 (moving towards the pressure waves created by the first and second initiators) increase in magnitude and collide with the pressure wave fronts generated by the first and second initiators. The interaction of these pressure wave fronts propagates radially and produces pressure wave interaction with the target pipe. Tertiary and subsequent pressure wave collisions are also produced by the secondary collisions.

Figure 4:
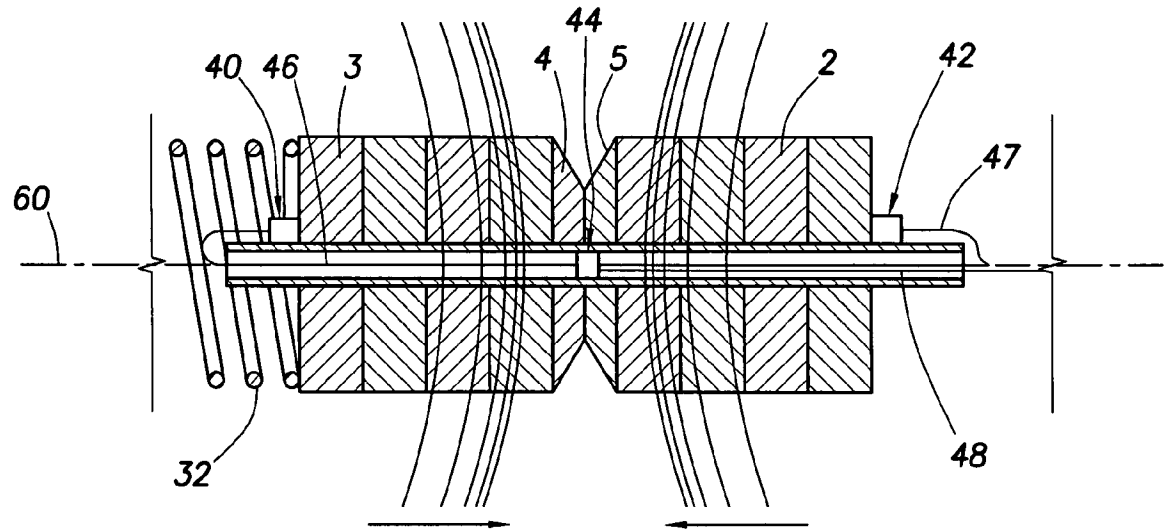
FIG. 4 is a cross-sectional diagram illustrating an explosive cartridge assembly and including multiple opposed wave fronts.

FIG. 4 illustrates the another embodiment of a multi-point initiation system where accurately timed initiation points and a shaped-charge explosive assembly produce multiple pressure wave fronts and effects that enhance the severing of the target pipe by pre-scoring the inner wall of the target pipe. In this embodiment, a first initiator 40 and a second initiator 42 are designed to be initiated simultaneously. At a predetermined time, the pressure wave fronts created by the first and second initiators have propagated in equal but opposing directions along the common axis 60. At a predetermined time, a third initiator 44 starts at a third initiation point between the first and second initiators. In this embodiment, the third initiation point is within a shaped-charge assembly. The explosive force of the shaped-charge assembly causes a jetting action of the liner of the shaped-charge assembly against the inner wall of the target pipe. In alternate embodiments, this shaped charge could have a no liner but still produce some of the same beneficial results. The pressure wave fronts created by the first and second initiators each create a relatively incompressible wave front propagating toward a point between the first and second initiators where the third initiator and shaped-charge assembly are located. The initiation and subsequent jet or metal particle effect created by the third initiator is focused and acts radially towards the target wall. Preferably, but not necessarily, the timing is accomplished such that a first severing effect is created by the pre-scoring of the target pipe prior to a second severing effect that is caused by the collision of the first and second opposing wave fronts. A highly focused radial effect is produced due to the confining pressure wave fronts that are converging upon the point of the third initiation. The enhancement and focusing achieved through this principle provides a highly effective cutting effect when the device is positioned and detonated within a tubular target and may provide beneficial effects in other targets. Severance is achieved through steel penetration and pressure wave interaction fracture mechanisms due to the high, applied pressure pulse within the confining and subsequent collision of the first and second pressure wave fronts.

Figure 5:
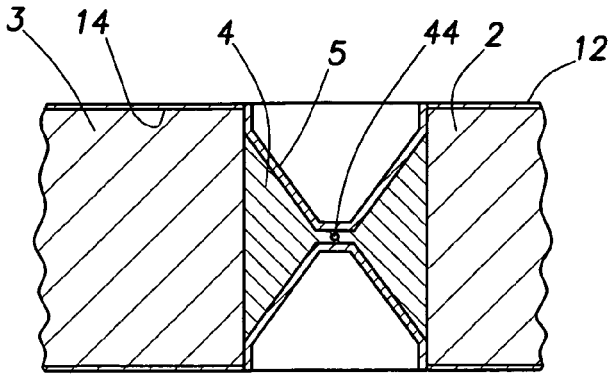
FIG. 5 is a cross-sectional diagram illustrating an explosive cartridge assembly with a shaped-charge with a conical liner.

FIG. 5 illustrates an embodiment of an explosive cartridge assembly incorporating a shaped-charge with a conical liner. The assembly includes a first region of explosive material 2, a second region of explosive material 3, and a third region of explosive material 4 which may be a different material combination than either material 2 or material 3. The third region of explosive material 4 is contained within a shaped charge having a liner 5 and an initiator 44.

Figure 6:
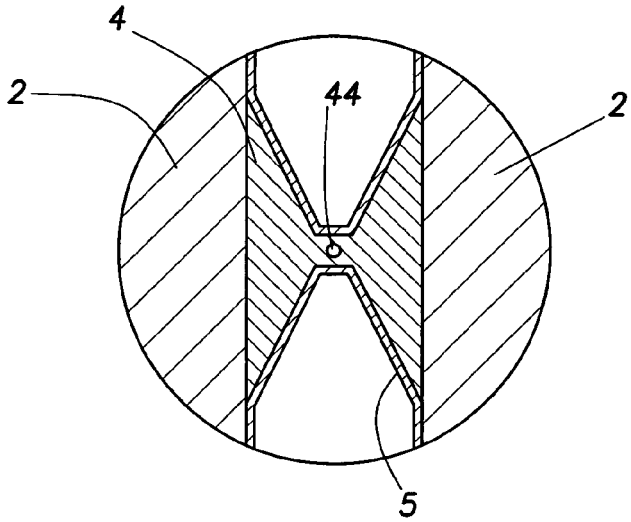
FIG. 6 is a cross-sectional diagram illustrating a shaped-charge with a conical liner with multiple initiators located at the outer circumference of a spherical charge.

FIG. 6 illustrates an embodiment of a collection of explosive material that is generally spherical in overall shape. The specific embodiment illustrated incorporates a shaped charge in the middle, but other embodiments may simply be a collection of explosively coupled explosive material without incorporating a shaped charge.

Figure 7:
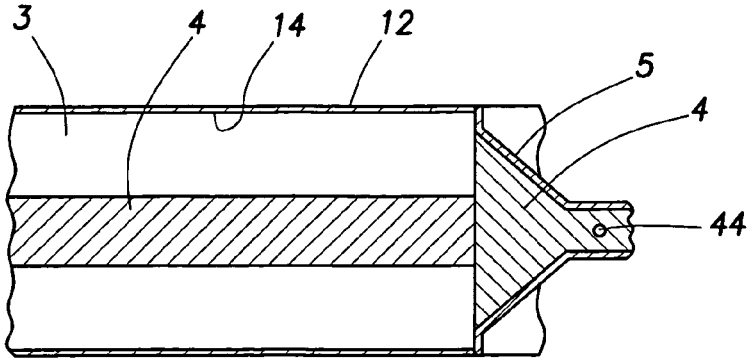
FIG. 7 is a cross-sectional diagram illustrating an explosive cartridge assembly and a shaped-charge including a conical liner having a hemispherical apex and further illustrating a multiple fast explosive material of relatively different detonation speeds.

FIG. 7 illustrates an embodiment of a portion of a collection of explosive material in which a region of explosive material 4 is made up of an outer annulus of one type of explosive material and in inner core of an alternative type of explosive material that may have a different rate of explosion.

A multi-point initiation severing tool of the type disclosed and a method of operation as described results in a more efficient explosive device due to the focusing and directional control of the explosive pressure wave achieved. Column length and diameter of the tool are determined by target size and operational requirements. The tool is intended to be relatively small in diameter and can be any length.

Although only a few embodiments of the present invention have been described, it should be understood that the present invention may be embodied in many other specific forms without departing from the spirit or the scope of the present invention. Therefore, the present examples are to be considered as illustrative and not restrictive, and the invention is not to be limited to the details given herein, but may be modified within the scope of the appended claims along with their full scope of equivalents.

What is claimed is:

1. An explosive severing device comprising:

an exterior housing having an interior extending between opposing distal ends of the housing;

an explosively coupled collection of explosive material located within the interior;

a first initiator coupled with the collection of explosive material at a first location;

a second initiator coupled with the collection of explosive material at a second location;

a third initiator coupled with the collection of explosive material at a third location between the first location and the second location; and, at least one detonator coupled to at least one of the initiators to initiate a timed sequence of initiation of the initiators contacting the explosive materials.

2. The device of claim 1, wherein the housing is approximately tubular.

3. The device of claim 1, wherein the collection of explosive material comprises a column of explosive material.

4. The device of claim 1, wherein the collection of explosive material comprises a spherical mass of explosive material.

5. The device of claim 4, wherein a plurality of the initiators are interspersed upon the surface of the spherical explosive material.

6. The device of claim 4, wherein a plurality of the initiators are interspersed within the surface of the spherical explosive material.

7. The device of claim 4, wherein a plurality of the initiators are interspersed in close proximity to but offset from the surface of the spherical explosive material.

8. The device of claim 1, wherein the first and second initiators are located at opposing ends of the explosive material and the third initiator is located at a point between the first and second initiators.

9. The device of claim 8, wherein the third initiator is coupled to a shaped-charge assembly located at a point between the first and second initiators.

10. The device of claim 8, wherein the third initiator is coupled to a shaped-charge assembly with a liner and is located at a point between the first and second initiators.

11. The device of claim 8, wherein the third initiator is located at a point between the first and second initiators and is coupled to the detonator in a manner designed to produce initiation at a pre-selected time.

12. The device of claim 11, wherein the pre-selected time is prior to the initiation of the first and second initiators.

13. The device of claim 11, wherein the pre-selected time is approximately simultaneous to the initiation of the first and second initiators.

14. The device of claim 11, wherein the pre-selected time is subsequent to the initiation of the first and second initiators.

15. The device of claim 1, wherein the first and second initiators are each coupled to the detonator in a manner designed to produce approximately simultaneous initiation of the first and second initiators.

16. The device of claim 1, where the initiators are electrical initiators.

17. The device of claim 1, where the initiators are explosive initiators.

18. The device of claim 1, where at least one of the initiators is an optical initiator.

19. The device of claim 1, wherein at least some of the initiators are electrical initiators and wherein at least some of the initiators are explosive initiators.

20. The device of claim 1, wherein the explosive materials have the same speed of propagation of a pressure wave.

21. The device of claim 1, wherein the explosive materials have different speeds of propagation of a pressure wave.

22. A method for severing a tubular structure comprising:

locating within the tubular structure an explosively coupled collection of explosive material having a first region, a second region, and a third region at least partially in between the first and second regions;

creating at least two pressure waves traveling through the explosive material by using at least one first initiator coupled to the first region of explosive material to initiate a first pressure wave in the first region of explosive material and by using at least one second initiator coupled to the second region of explosive material to initiate a second pressure wave in the second region of explosive material;

creating at least one additional pressure wave in between the first and second pressure waves by using at least one third initiator coupled to the third region of explosive material to initiate a third pressure wave in the third region of explosive material.

23. The method of claim 22 wherein the first and second pressure waves are initiated approximately simultaneously.

24. The method of claim 23 wherein the third pressure wave is initiated prior to the initiation of the first and second pressure waves.

25. The method of claim 23 wherein the third pressure wave is initiated approximately subsequent to the initiation of the first and second pressure waves.

26. The method of claim 23 wherein the third pressure wave is initiated simultaneously to the initiation of the first and second pressure waves.

27. The method of claim 23 wherein the coupling point of the third initiator is the initiation site of the third pressure wave; and, wherein the third pressure wave is initiated prior to the arrival of either the first or second pressure wave at the initiation site of the third pressure wave.

28. The method of claim 22 wherein the first and second pressure waves are initiated sequentially.

29. The method of claim 22 wherein a primary detonator is used to begin the timed initiation of the pressure waves; and, wherein the timing of the initiation of the pressure waves is controlled by the use of initiation assemblies of defined length coupling the primary detonator to the initiation sites of the respective pressure waves contacting the respective regions of explosive material generating the respective waves.

30. The method of claim 22 wherein a primary detonator is used to begin the timed initiation of the pressure waves; and, wherein the timing of the initiation of the pressure waves is controlled by the use of electrical initiators coupling the primary detonator to the initiation sites of the respective pressure waves contacting the respective regions of explosive material generating the respective waves.

31. The method of claim 22 wherein a primary detonator is used to begin the timed initiation of the pressure waves; and, wherein the timing of the initiation of the pressure waves is controlled by the use of optical initiators coupling the primary detonator to the initiation sites of the respective pressure waves contacting the respective regions of explosive material generating the respective waves.

32. The method of claim 22 wherein a primary detonator is used to begin the timed initiation of at least some of the pressure waves; and, wherein the timing of the initiation of the first and second pressure waves is controlled by the use of initiation assemblies of equal length coupling the primary detonator to the initiation sites contacting the first and second regions of explosive material respectively.

33. The method of claim 22 wherein a primary detonator is used to begin the timed initiation of at least some of the pressure waves; and, wherein the timing of the initiation of the first and second pressure waves is controlled by the use of initiation assemblies of unequal length coupling the primary detonator to the initiation sites contacting the first and second regions of explosive material respectively.

34. The method of claim 22 wherein a primary detonator is used to begin the timed initiation of at least some of the pressure waves; and, wherein the timing of the initiation of the first and second pressure waves is controlled by the use of electrical initiators coupling the primary detonator to the initiation sites contacting the first and second regions of explosive material respectively.

35. The method of claim 22 wherein the third region of explosive material comprises a shaped-charge; and wherein the shaped-charge is initiated prior to the arrival of either the first or second pressure wave at the initiation site of the shaped-charge.

36. The method of claim 35, wherein the shaped charge in the third region of explosive material has a liner.

37. The method of claim 36, wherein the shaped-charge pre-scores the tubular structure radially outward from the shaped-charge prior to the arrival either the first or second pressure wave at the tubular structure radially outward from the shaped-charge.

38. The method of claim 36, wherein the shaped-charge pre-scores the tubular structure radially outward from the shaped-charge approximately simultaneously to the arrival of the first and of the second pressure wave at the tubular structure radially outward from the shape-charge.

39. A method for impacting a structure, wherein the method comprises:

locating proximate to the structure an explosively coupled collection of explosive material having a first region, a second region, and a third region at least partially in between the first and second regions;

creating at least two pressure waves traveling through the explosive material by using at least one first initiator coupled to the first region of explosive material to initiate a first pressure wave in the first region of explosive material and by using at least one second initiator coupled to the second region of explosive material to initiate a second pressure wave in the second region of explosive material;

creating at least one additional pressure wave in between the first and second pressure waves by using at least one third initiator coupled to the third region of explosive material to initiate a third pressure wave in the third region of explosive material.

* * * * *